United States Patent [19]

Kogen

[11] Patent Number: 5,035,123

[45] Date of Patent: Jul. 30, 1991

[54] EARRING CUSHION AND METHOD OF MAKING SAME

[76] Inventor: Robert A. Kogen, 905 Exeter Crest, Villanova, Pa. 19085

[21] Appl. No.: 490,105

[22] Filed: Mar. 7, 1990

[51] Int. Cl.[5] ..... A44C 7/00

[52] U.S. Cl. ..... 63/14.3; 156/292

[58] Field of Search ..... 29/160.6; 156/292; 63/14.1, 14.3, 14.4, 14.5

[56] References Cited

U.S. PATENT DOCUMENTS

| | | | |
|---|---|---|---|
| 2,763,999 | 9/1956 | Norman | 63/14.3 |
| 2,775,014 | 12/1956 | Gollobin | 63/14.3 X |
| 2,795,118 | 6/1957 | Shill | 63/14.3 |
| 2,819,595 | 1/1958 | Northup | 63/14.3 |
| 2,952,998 | 9/1960 | Lawrence | 63/14.3 |
| 4,701,967 | 10/1987 | Strobel | 156/292 X |

*Primary Examiner*—James R. Brittain

*Attorney, Agent, or Firm*—Caesar, Rivise, Bernstein, Cohen & Pokotilow, Ltd.

[57] ABSTRACT

An earring pad and method of making it. The pad is arranged for releasable securement to a portion of a clip-on earring and comprises a base member, a barrier member, and a foam member. The base member and barrier member are each formed of a planar, relatively flexible, plastic, having outer and inner surfaces bounded by a peripheral edge. The foam member has a peripheral edge configuration corresponding to that of the barrier member. The foam member is disposed over the outer surface of the barrier member and they are heat sealed together along their entire peripheral edges. The base member is disposed over the inner surface of the barrier member and it is heat sealed to the barrier member along only a portion its peripheral edge to form a hollow pocket having an open mouth to receive the portion of the clip-on earring.

16 Claims, 1 Drawing Sheet

FIG. 2
PRIOR ART
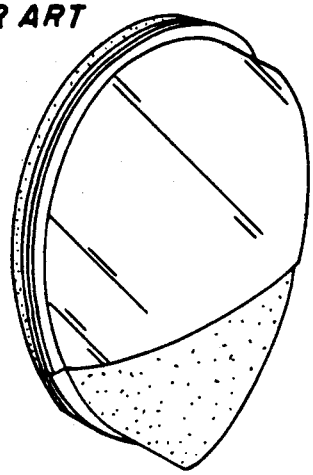
FIG. 1
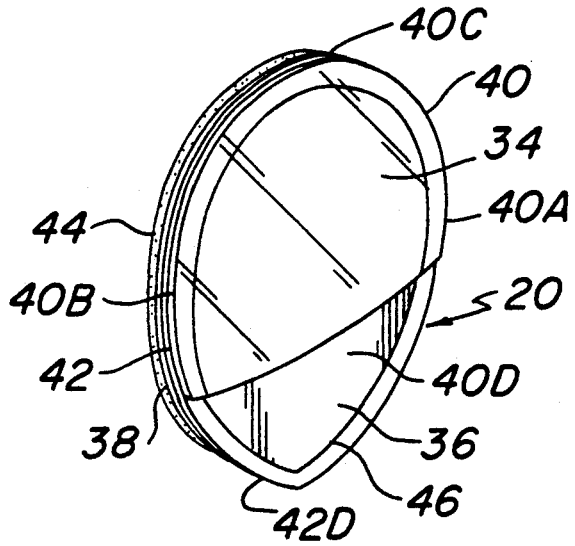
FIG. 3
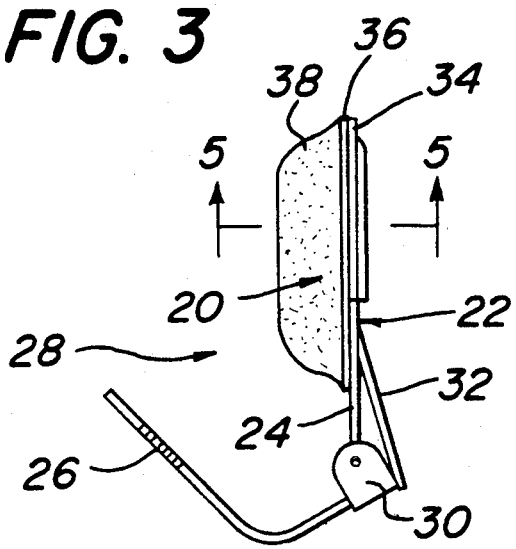
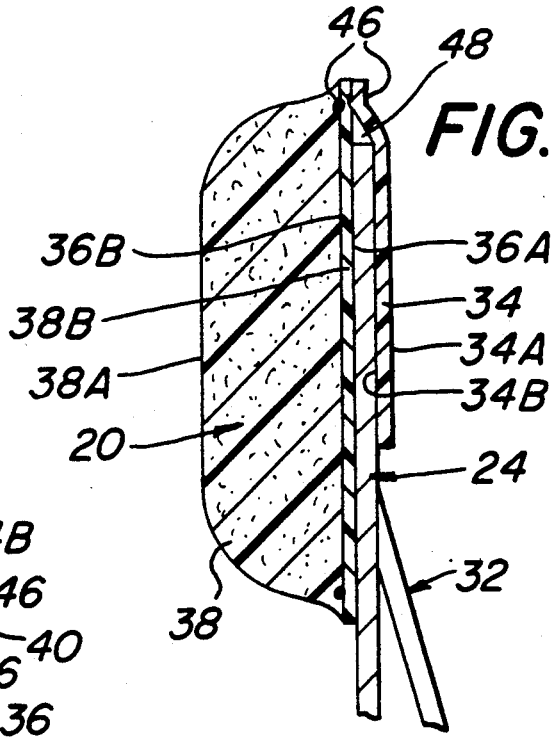
FIG. 4
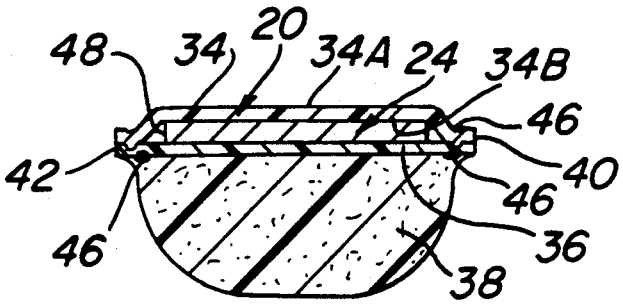
FIG. 5

EARRING CUSHION AND METHOD OF MAKING SAME

BACKGROUND OF THE INVENTION

This invention relates generally to pads and more particularly to cushioned pads for releasable securement to clip-on type earrings.

In U.S. Pat. No. 2,952,998 (Lawrence) there is disclosed a pad arranged for releasable securement to a portion of a conventional clip-on earring to cushion the engaging portion of the wearer's ear. To that end the pad includes a planar base member having a predetermined shape formed of a thermoplastic material, and to which is secured a resilient member in the form of foam pad of a similar shape to that of the base member. The foam member is heat sealed to the base member along a portion of the peripheral edge of each to form a hollow pocket with the unsealed peripheral edge portions of the two members forming an entrance mouth to a pocket. The gripping portion of the earring is disposed within the hollow pocket to hold the pad in place thereon.

Ear pads constructed in accordance with the teachings of the foregoing patent have been commercially available and are shown in FIG. 2 designated by the legend "Prior Art". These pads, as well as the pads disclosed in the aforegoing United States patent, while suitable for their intended purposes, nevertheless leave something to be desired from the standpoint of longevity of use and effectiveness. In this connection it has been determined that the insertion of the earring's clip (gripping) portion into the pocket causes that portion to directly engage the foam material making up the pad. This action has the effect of eroding or otherwise damaging the somewhat fragile foam, particularly if the pad is repeatedly put on and removed from the earring clip.

OBJECTS OF THE INVENTION

Accordingly, it is a general object of this invention to provide an earring pad and method of making the same which overcomes the disadvantages of the prior art.

It is a further object of this invention to provide a cushioned earring pad which is more rugged in construction than prior art devices.

It is still a further object of this invention to provide an expeditious and simple method of making a earring pad.

SUMMARY OF THE INVENTION

These and other objects of this invention are achieved by providing a cushioned earring pad for releasable securement to a portion of a clip-on earring and a method of making that pad.

The pad comprises a base member, a barrier wall member, and a resilient member. The base member is formed of a planar, relatively flexible, first plastic material and has outer and inner surfaces bounded by a peripheral edge. The barrier wall member is formed of a planar, relatively flexible, second plastic material and has outer and inner surfaces bounded by a peripheral edge. The resilient member is formed of a foam material and has an outer configuration corresponding to that of the barrier member. The barrier member and the resilient member are heat sealed to each other along their entire peripheral edges, while the base member is heat sealed to the barrier wall member along only a portion of the peripheral edge of the base member. A hollow pocket is created between the barrier wall member and the base member, with the hollow pocket having an open entrance mouth defined between the unsealed peripheral edge of the base member and the contiguous portion of the barrier wall member. The pocket is adapted to receive the portion of the clip-on earring therein through the entrance mouth. The barrier wall member protects the material of the resilient member from wear when the portion of the clip-on earring is located within the pocket.

The method of making the pad comprises forming a planar, relatively flexible, first plastic material into the base member, forming a planar, relatively flexible second plastic material into the barrier wall member, and forming a resilient foam material into the resilient member. The inner surface of the resilient member is disposed over the outer surface of the barrier wall member so that the peripheral edges thereof are coincident. The inner surface of the base member is disposed over the inner surface of the barrier wall member so that portions of the peripheral edges thereof are coincident. The resilient member and the barrier wall member are heat sealed to each other along their entire peripheral edges, and the base member and the barrier wall member are heat sealed to each other along only a portion of the peripheral edge of the base member, to thereby form the hollow pocket for receiving the portion of the clip-on earring.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a isometric view of a cushioned earring pad constructed in accordance with this invention;

FIG. 2 is a isometric view, similar to that of FIG. 1, but showing of a cushioned earring pad constructed in accordance with the prior art;

FIG. 3 is a reduced side elevational view of a portion of a conventional clip-on type earring on which is mounted a cushioned earring pad like that shown in FIG. 1;

FIG. 4 is an enlarged vertical sectional view of a portion of the clip-on type earring with the cushioned earring thereon as shown in FIG. 3; and FIG. 5 is an enlarged sectional view taken along line 5—5 of FIG. 3.

DETAILED DESCRIPTION OF THE PREFERRED EMBODIMENTS

Referring now to various figures of the drawing where like reference numerals refer to like parts there is shown at 20 in FIG. 1 a cushioned earring pad constructed in accordance with this invention for use with a conventional clip-on type of earring. As is known such earrings include a clamp or clip which is arranged to grasp a portion of the wearer's earlobe to hold the earring thereon. The pad of this invention is arranged to be mounted on the clip so as to cushion the wearer's earlobe from the clamping force created thereby.

In FIG. 3 there is shown a typical clip 22 of a conventional clip-on type earring (not shown). As can be seen the clip 22 basically comprises first and second gripping members 24 and 26, respectively, which are pivotably connected to each other to form a space 28 therebetween for receipt of the wearer's earlobe.

The member 24 basically comprises a planar, strip-like element terminating at one end in a hinge assembly 30. The member 26 also basically comprises a strip-like element having a free end portion 26A. In addition member 26 includes an angled extending portion 26B which terminates at the hinge assembly 30. Accordingly, the two members 24 and 26 may be pivoted toward and away from each other to vary the size of the space 28 therebetween. The member 24 also includes a leaf spring element 32 which engages a portion of the hinge assembly 30 to bias the members 24 and 26 together. As will be appreciated it is this biasing action which effects the securement of the clip onto the wearer's earlobe when the earlobe is located in space 28.

In accordance with the teachings of this invention the cushioned earring pad 20 is arranged to be disposed on either of the gripping members 24 or 26, although in the drawing herein it is shown mounted on the member 24. Normally a single pad 20 should be sufficient to alleviate any discomfort caused by excessive pressure of the earring. However, for some applications the user may desire you use a cushioned earring pad 20 on each of the gripping members 24 and 26.

The pad 20 basically comprises a base member 34, a barrier wall member 36, and a resilient, earlobe engagement member 38. The base member 34 is formed of a generally planar, somewhat flexible, material which is cut into the desired shape (to be described hereinafter). Preferably that material comprises a thermoplastic synthetic resinous sheet material which is transparent. When cut into the desired shape, the base member 34 includes a generally planar outer surface 34A, and a generally planar inner surface 34B, with the surfaces being bounded by a peripheral edge 40.

As shown clearly in FIG. 2 the peripheral edge 40 of the base member includes an opposed pair of slightly arcuate side edges 40A and 40B, a generally arcuate top end edge 40C, and a generally linear bottom end edge 40D. The bottom edge 40D is located opposite the arcuate top end edge 40C.

The barrier member 36 is also formed from a generally planar, somewhat flexible material. Preferably that material comprises a thermoplastic synthetic resinous sheet material, e.g., semi rigid vinyl That member includes an outer surface 36A (FIG. 4) and an inner surface 36B, with the surfaces bounded by a peripheral edge 42. As can be seen the periphery of the barrier member is generally of a tear-drop shape and is generally coextensive in size and shape with the base member, except that it does not include a lower linear edge (as does the base member 34). Instead the barrier wall member's lower peripheral edge 42D is of a general V-shape and projects beyond the linear edge 40D.

The resilient earlobe engaging member 38 is formed from a blank of cushioned material. In accordance with the preferred embodiment of the invention the material comprises a thermoplastic foam material, e.g., polyvinyl foam. The foam member 38 has a top or outer surface 38A, and a generally planar bottom or inner surface 38B, with the surfaces being bounded by a peripheral edge 44 of the same shape and size as that of the peripheral edge 42 of the barrier wall member 36. As can be seen the foam member 38 is substantially thicker than the thickness of either barrier wall member 36 or the base member 34.

The base member 34, the barrier wall member 36, and the foam member 38 are secured to one another to form the pad 20. Thus, as can be seen in FIG. 2 the barrier wall member 36 and the foam member 38 are disposed so that they are coincident, with the inner surface 38B of the foam member abutting the outer surface 36B of the barrier wall member 36. The peripheral edges 42 and 44 of the members 36 and 38, respectively, are sealed to each other via a peripheral heat seal line 46 (FIGS. 2, 4 and 5). Such heat sealing may be carried out by any conventional means and/or technique. The base member 34 is also heat sealed to the barrier wall member 36 via heat seal line 46. To that end the base member is located over the barrier wall member so that the inner surface 34B of the base member is disposed on the inner surface 36A of the barrier wall member and with the corresponding curved edges of the periphery of the base member aligned with the corresponding curved edges of the barrier wall member so that they are coincident.

As can be seen clearly in FIGS. 4 and 5 the sealing of the peripheral edges of the foam member 38 to the barrier wall member 38 causes the central portion of the foam member to have the greatest resilient effect, while securing the edges to the barrier member prevents any substantial distortion of the cushion when in use.

The securement of the peripheral edges of the base member 34, except for its lower linear edge 40D, to the corresponding edges of the barrier wall member 36, results in the creation of a hollow chamber or pocket 48 (FIGS. 4 and 5) between the inner surface 34B of the base member and the inner surface 36A of the barrier wall member. In addition, inasmuch as the edge 40D of the base member is unsealed to the underlying barrier wall member an entrance mouth is formed therebetween. It is through the entrance mouth that either gripping member 24 or 26 of the earring clip may be inserted into the pocket 48.

As should be appreciated by those skilled in the art the relatively smooth and somewhat hard inner surface of the barrier wall member enables the ready insertion of either of the gripping member 24 and 26 of the earring into the pocket, while protecting the more delicate foam material of the member 38 from damage thereby. Moreover, the barrier wall of the pad of the subject invention serves to protect the foam material from erosion caused by pressure of the earring's gripping members on the foam. This feature is of considerable importance to ensure longevity of the earring cushion. Further still, the somewhat rigid nature of the barrier wall provides additional reinforcing to the earring cushion to prevent the distortion thereof when worn. This furthers insures that the foam pad is not eroded by the application of pressure thereto via the gripping member.

In FIG. 2 there is shown a prior art earring pad which is similar in construction to that of the subject invention (so that common components are given the same reference numerals) except that it does not make use of any barrier wall member. Thus, the foam member of the prior art pad forms the inner wall of the pocket that receives the earring's clip member and is hence subject to damage (erosion, etc.) as described heretofore.

Without further elaboration the foregoing will so fully illustrate my invention that others may, by applying current or future knowledge, adopt the same for use under various conditions of service.

I claim:

1. A cushioned earring pad for releasable securement to a portion of a clip-on earring, said pad comprising a base member, a barrier wall member, and a resilient member, said base member being formed of a planar, relatively flexible, first plastic material and having outer and inner surfaces bounded by a peripheral edge, said barrier wall member being formed of a planar, relatively flexible, second plastic material and having outer and inner surfaces bounded by a peripheral edge, said resilient member being formed of a foam material and having an outer configuration corresponding to that of said barrier member, said barrier member and said resilient member being heat sealed to each other along their entire peripheral edges, said base member being heat sealed to said barrier wall member along only a portion of the peripheral edge of said base member thereby forming a free marginal edge portion of said base member and a hollow pocket between said barrier wall member and said base member, with said hollow pocket having an open entrance mouth defined between the free marginal edge portion of said base member and the contiguous portion of said barrier wall member, said free marginal edge portion extending generally linearly transversely across substantially the full width of said barrier wall member, said entrance mouth being located at an intermediate position along said pad, whereupon a portion of said barrier wall member is not covered by said base member to form an outer surface extending beyond said free marginal edge portion over which a portion of said clip-on earring may readily slide to enable said earring portion to readily enter said pocket through said entrance mouth, said barrier wall member protecting the material of said resilient member from wear when said portion of said clip-on earring is located within said pocket.

2. The pad of claim wherein said second plastic material comprises semi-rigid vinyl.

3. The pad of claim 2 wherein said foam comprises thermoplastic synthetic resinous foam.

4. The pad of claim 3 wherein said foam is polyvinyl.

5. The pad of claim 1 wherein said barrier wall member and said resilient member are each of generally tear-drop shape having a generally pointed portion and wherein said linear edge of said base member extends across said barrier wall member spaced inward from said pointed portion.

6. The pad of claim 5 wherein said second plastic material comprises semi-rigid vinyl.

7. The pad of claim 6 wherein said foam comprises thermoplastic synthetic resinous foam.

8. The pad of claim 7 wherein said foam is polyvinyl.

9. A method of making an earring pad for releasable securement to a portion of a clip-on earring, said method comprising forming a planar, relatively flexible, first plastic material into a base member having outer and inner surfaces bounded by a peripheral edge, forming a planar, relatively flexible second plastic material into a barrier wall member having outer and inner surfaces bounded by a peripheral edge, forming a resilient foam material into a resilient member having outer and inner surfaces bounded by a peripheral edge whose configuration corresponds to that of said barrier member, disposing said inner surface of said resilient member over said outer surface of said barrier wall member so that the peripheral edges thereof are coincident, and disposing said inner surface of said base member over said inner surface of said barrier wall member so that portions of the peripheral edges there of are coincident, but with a free marginal edge portion of said base member not being coincident with corresponding portions of said barrier wall member, and heat sealing said resilient member and said barrier wall member to each other along their entire peripheral edges, and heat sealing said base member and said barrier wall member to each other along their contiguous portions of the peripheral edge of said base member but not along said free marginal edge portion, to thereby form a hollow pocket between said barrier wall member and said base member, with said hollow pocket having an open entrance mouth located at an intermediate position on said pad and being defined between said free marginal edge portion of said base member and the contiguous portion of said barrier wall member to leave a portion of said barrier wall member not covered by said base member, said free marginal edge portion extending generally linearly transversely across substantially the full width of said barrier wall member, said pocket adapted to receive said portion of said clip-on earring therein through said entrance mouth, with the uncovered portion of the barrier wall member forming an outer surface extending beyond said free marginal edge portion and across which a portion of the clip-on earring may slide for ready insertion into said pocket.

10. The method of claim 9 wherein said second plastic material is selected to be semi-rigid vinyl.

11. The method of claim 10 wherein said foam is selected to be thermoplastic synthetic resinous foam.

12. The method of claim 11 wherein said foam is selected to be polyvinyl.

13. The pad of claim 9 wherein said barrier wall member and said resilient member are each formed into a generally tear-drop shape, said shape having a generally pointed portion, and wherein said linear edge of said base member is oriented so that it extends across said barrier wall member spaced inward from said pointed portion.

14. The method of claim 13 wherein said second plastic material is selected to be semi-rigid vinyl.

15. The method of claim 14 wherein said foam is selected to be thermoplastic synthetic resinous foam.

16. The method of claim 15 wherein said foam is selected polyvinyl.

* * * * *